US009212638B2

(12) United States Patent
Kato

(10) Patent No.: US 9,212,638 B2
(45) Date of Patent: Dec. 15, 2015

(54) FUEL INJECTION APPARATUS

(71) Applicant: DENSO CORPORATION, Kariya, Aichi-pref (JP)

(72) Inventor: Masaaki Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 304 days.

(21) Appl. No.: 13/966,850

(22) Filed: Aug. 14, 2013

(65) Prior Publication Data

US 2014/0102414 A1 Apr. 17, 2014

(30) Foreign Application Priority Data

Oct. 11, 2012 (JP) ..... 2012-225961

(51) Int. Cl.

| | |
|---|---|
| ***F02M 51/00*** | (2006.01) |
| ***F02M 39/00*** | (2006.01) |
| ***F02M 55/04*** | (2006.01) |
| ***F02M 59/36*** | (2006.01) |

(52) U.S. Cl.

CPC ..... *F02M 39/005* (2013.01); *F02M 55/04* (2013.01); *F02M 59/368* (2013.01); *F02M 2200/315* (2013.01); *F02M 2200/40* (2013.01); *F02M 2200/953* (2013.01)

(58) Field of Classification Search

CPC ..... F02D 41/20

USPC ..... 123/490, 491, 445, 446, 456, 478, 480, 123/495

See application file for complete search history.

(56) References Cited

U.S. PATENT DOCUMENTS

| | | | | |
|---|---|---|---|---|
| 5,624,072 | A | 4/1997 | Okajima et al. | |
| 6,021,759 | A | 2/2000 | Okajima et al. | |
| 8,555,860 | B2 * | 10/2013 | McAlister | 123/490 |
| 8,733,331 | B2 * | 5/2014 | McAlister | 123/623 |
| 2013/0047946 | A1 * | 2/2013 | Hartke et al. | 123/143 B |
| 2013/0298864 | A1 * | 11/2013 | Nuebel et al. | 123/143 C |

FOREIGN PATENT DOCUMENTS

| | | |
|---|---|---|
| JP | 7-310620 | 11/1995 |
| JP | 11-072053 | 3/1999 |
| JP | 2008-038850 | 2/2008 |
| JP | 2010-196471 | 9/2010 |
| JP | 2010-196687 | 9/2010 |
| JP | 2010-203286 | 9/2010 |
| JP | 2012-062759 | 3/2012 |

OTHER PUBLICATIONS

Office Action (2 pages) dated Sep. 16, 2014, issued in corresponding Japanese Application No. 2012-225961 and English translation (2 pages).

* cited by examiner

*Primary Examiner* — John Kwon

(74) *Attorney, Agent, or Firm* — Nixon & Vanderhye PC

(57) ABSTRACT

A liquefied gas fuel is supplied to a fuel gallery of a high-pressure pump through a feed pipe. A fuel injection apparatus includes a passage expansion pipe of which passage area is greater than that of the fuel gallery. The passage expansion pipe is arranged between the feed pipe and the fuel gallery. When the fuel is supplied to the fuel gallery during a suction stroke of a plunger, the passage expansion pipe functions as an accumulator accumulating the fuel therein. The replenishing fuel from the passage expansion pipe is added to the fuel supplied from the feed pump. A pressure drop in the fuel gallery becomes small, so that the pressure pulsation in the fuel gallery is reduced.

5 Claims, 5 Drawing Sheets

FUEL INJECTION APPARATUS

CROSS-REFERENCE TO RELATED APPLICATION

This application is based on Japanese Patent Application No. 2012-225961 filed on Oct. 11, 2012, the disclosure of which is incorporated herein by reference.

TECHNICAL FIELD

The present invention relates to a fuel injection apparatus which injects liquefied gas fuel into an internal combustion engine.

BACKGROUND

JP-2010-196687A shows a fuel injection apparatus in which a liquefied gas fuel (for example, dimethyl ether: DME) in a fuel tank is supplied to a high-pressure pump by a feed pump and the pressurized fuel is supplied to a fuel injector through a common-rail. The fuel injector injects the liquefied gas fuel into a cylinder of an internal combustion engine.

The high-pressure pump is provided with a plunger which reciprocates and pressurizes the liquefied gas fuel. A housing of the high-pressure pump defines a plunger chamber in which the plunger is accommodated. Further, the housing defines a fuel gallery into which the liquefied gas fuel is introduced from the fuel tank. The liquefied gas fuel in the fuel gallery is supplied to the plunger chamber. Furthermore, the high-pressure pump is provided with a solenoid valve which opens and closes a communication passage which fluidly connects the fuel gallery and the plunger chamber. When the solenoid valve is energized to attract a valve body, the communication passage is closed.

In the above fuel injection apparatus, when the plunger is at suction stroke, the liquefied gas fuel is suctioned from the fuel gallery into the plunger chamber, whereby a fuel pressure in the fuel gallery is decreased. When it is unnecessary to supply the liquefied gas fuel to a common-rail, the liquefied gas fuel in the plunger chamber is returned to the fuel gallery at discharge stroke, whereby the fuel pressure in the fuel gallery is increased. Therefore, the pressure in a fuel gallery is significantly varied which generates a pressure pulsation.

When the fuel pressure in the fuel gallery is decreased, the fuel pressure in the fuel gallery becomes lower than a vapor pressure of the liquefied gas fuel, so that the liquefied gas fuel is vaporized. It is likely that the plunger chamber is filled with the vaporized fuel and a vapor lock may occur.

Meanwhile, when the fuel pressure in the fuel gallery is increased, it is likely that the fuel pressure in a fuel gallery may exceed a pressure resistance of an O-ring which maintains the oil-tight of the fuel gallery. It is likely that the O-ring may be broken and the fuel may leak outside.

SUMMARY

It is an object of the present disclosure to provide a fuel injection apparatus which can reduce a pressure pulsation in a fuel gallery.

According to an aspect of the present disclosure, a fuel injection apparatus has a fuel tank containing a liquefied gas fuel, a feed pump feeding the liquefied gas fuel from the fuel tank, a high-pressure pump pressurizing and discharging the liquefied gas fuel supplied from the feed pump, and a feed pipe introducing the liquefied gas fuel to the high-pressure pump from the feed pump.

The high-pressure pump includes: a plunger reciprocating to pressurize the liquefied gas fuel; a plunger reciprocating to pressurize the liquefied gas fuel; a housing defining a plunger chamber of which volume is varied according to a reciprocating movement of the plunger. Further, the housing defines a fuel gallery into which the liquefied gas fuel is introduced through the feed pipe and from which the liquefied gas fuel is supplied to the plunger chamber. The high-pressure pump further includes a solenoid valve opening and closing a communication passage fluidly connecting the fuel gallery and the plunger chamber. The fuel injection apparatus further includes a passage expansion pipe of which passage area is greater than that of the fuel gallery. The passage expansion pipe is arranged between the feed pipe and the passage expansion pipe.

The passage expansion pipe functions as an accumulator accumulating the fuel therein. The replenishing fuel from the passage expansion pipe is added to the fuel supplied from the feed pump. A pressure drop in the fuel gallery becomes small, so that the pressure pulsation in the fuel gallery is reduced. Therefore, the pressure pulsation in the fuel gallery is reduced and a vaporization of the liquefied gas fuel in the fuel gallery is restricted, whereby the fuel can be certainly pressure-fed.

According to another aspect of the present disclosure, a fuel injection apparatus has a fuel tank containing a liquefied gas fuel, a feed pump feeding the liquefied gas fuel from the fuel tank, a high-pressure pump pressurizing and discharging the liquefied gas fuel supplied from the feed pump, and a feed pipe introducing the liquefied gas fuel to the high-pressure pump from the feed pump.

The high-pressure pump is provided with a plunger reciprocating to pressurize the liquefied gas fuel, a housing, a solenoid valve, an overflow valve, and a passage expansion pipe. The housing defines a plunger chamber of which volume is varied according to a reciprocating movement of the plunger, and the housing defines a fuel gallery into which the liquefied gas fuel is introduced through the feed pipe and from which the liquefied gas fuel is supplied to the plunger chamber. The solenoid valve opens and closes a communication passage fluidly connecting the fuel gallery and the plunger chamber. The overflow valve has a valve body which moves in a valve-open direction so as to return the liquefied gas fuel in the fuel gallery to the fuel tank when a pressure in the fuel gallery becomes greater than a predetermined pressure. The passage expansion pipe has a passage area which is greater than that of the fuel gallery. The passage expansion pipe is arranged between the fuel gallery and the overflow valve.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present invention will be described with reference to accompanying drawings. It should be noted that similar components of one embodiment of the present specification, which are similar to the components of the other embodiment, will be designated by the same numerals.

First Embodiment

A fuel injection apparatus 1 is for injecting liquefied gas fuel into an internal combustion engine (not shown). The liquefied gas fuel is dimethyl ether (DME), liquefied petroleum gas (LPG), and the like.

Figure 1:
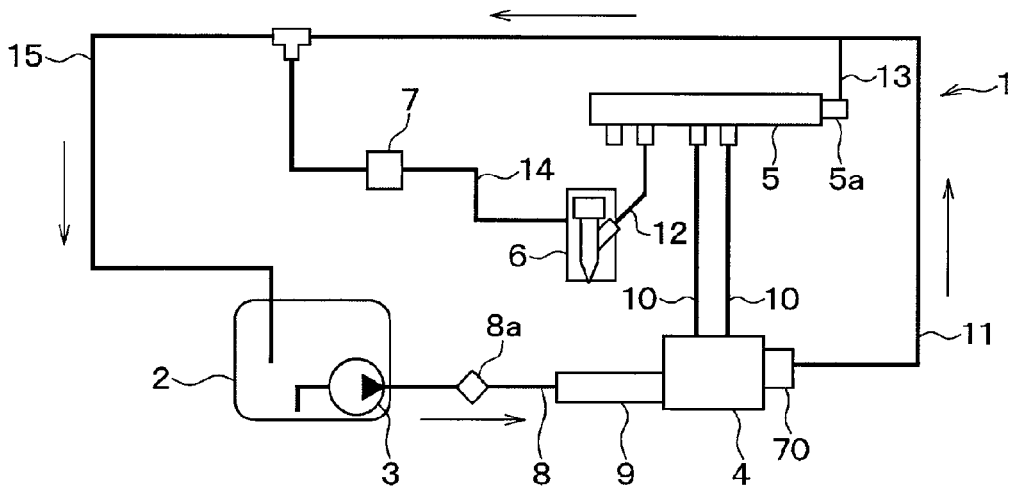
FIG. 1 is a chart schematically showing an entire structure of a fuel injection apparatus according to first embodiment.

As shown in FIG. 1, the fuel injection apparatus 1 is provided with a fuel tank 2, a feed pump 3, a high-pressure pump 4, a common-rail 5, a fuel injector 6, and a backpressure valve 7. These components 2 to 7 are fluidly connected with each other through pipes 8 to 15.

The fuel tank 2 stores DME fuel as the liquefied gas fuel. The feed pump 3 is provided in the fuel tank 2. The feed pump 3 supplies the liquid fuel in the fuel tank 1 to the high-pressure pump 4 through the feed pipe 8 and the passage expansion pipe 9. A filter 8*a* is disposed in the feed pipe 8.

The feed pump 3 is an electric rotary pump which supplies a specified amount of fuel to the high-pressure pump 4 based on command signals transmitted from an electronic control unit (ECU: not shown). The ECU includes a microcomputer having a CPU, a ROM, and a RAM. The microcomputer executes various programs based on output signals from various sensors.

The high-pressure pump 4 pressurizes the fuel supplied from the feed pump 3, and supplies the pressurized fuel to the common-rail 5 through the fuel pipe 10. In the present embodiment, the high-pressure pump 4 is driven by the internal combustion engine.

The high-pressure pump 4 has an overflow valve 70 which discharges the fuel when the pressure in the fuel gallery 49 becomes greater than or equal to a predetermined pressure. Moreover, the high-pressure pump 4 is connected to the fuel pipe 11 for returning the fuel which flowed out from the high-pressure pump 4 through the overflow valve 70 into the fuel tank 2.

The common-rail 5 accumulates the fuel pressurized by the high-pressure pump 4. The common-rail 5 is connected to the fuel injector 6 through the fuel pipe 12. The common-rail 5 has a relief valve 5*a* which flows out the fuel in the common-rail 5 when the fuel pressure in the common-rail 5 exceeds a predetermined pressure. Moreover, the common-rail 5 is connected to the fuel pipe 13 for returning the fuel which flowed out from the common-rail 5 through the relief valve 5*a* to the fuel tank 2.

The fuel injector 6 is provided to corresponding cylinder of the internal combustion engine. In FIG. 1, only one fuel injector 6 corresponding to one cylinder is indicated.

The fuel injector 6 injects the fuel supplied from the common-rail 5 to each cylinder of the internal combustion engine at a specified time point and for specified time period. Specifically, the fuel injector 6 is controlled by adjusting the fuel pressure in a backpressure chamber (not shown).

The fuel overflowed from the fuel injector 6 is returned to the fuel tank 2 through the fuel pipe 14 connected to the fuel injector 6. It should be noted that the fuel overflowed from the fuel injector 6 corresponds to surplus fuel supplied o the fuel injector 6 and the fuel discharged from the backpressure chamber of fuel injector 6.

The fuel pipe 14 has a backpressure valve 7 which opens when the fuel pressure of the surplus fuel or the discharge fuel becomes greater than or equal to a specified value.

The fuel pipes 11, 13, and 14 converge to define a fuel pipe 15 which is connected to the fuel tank 2.

Figure 2:
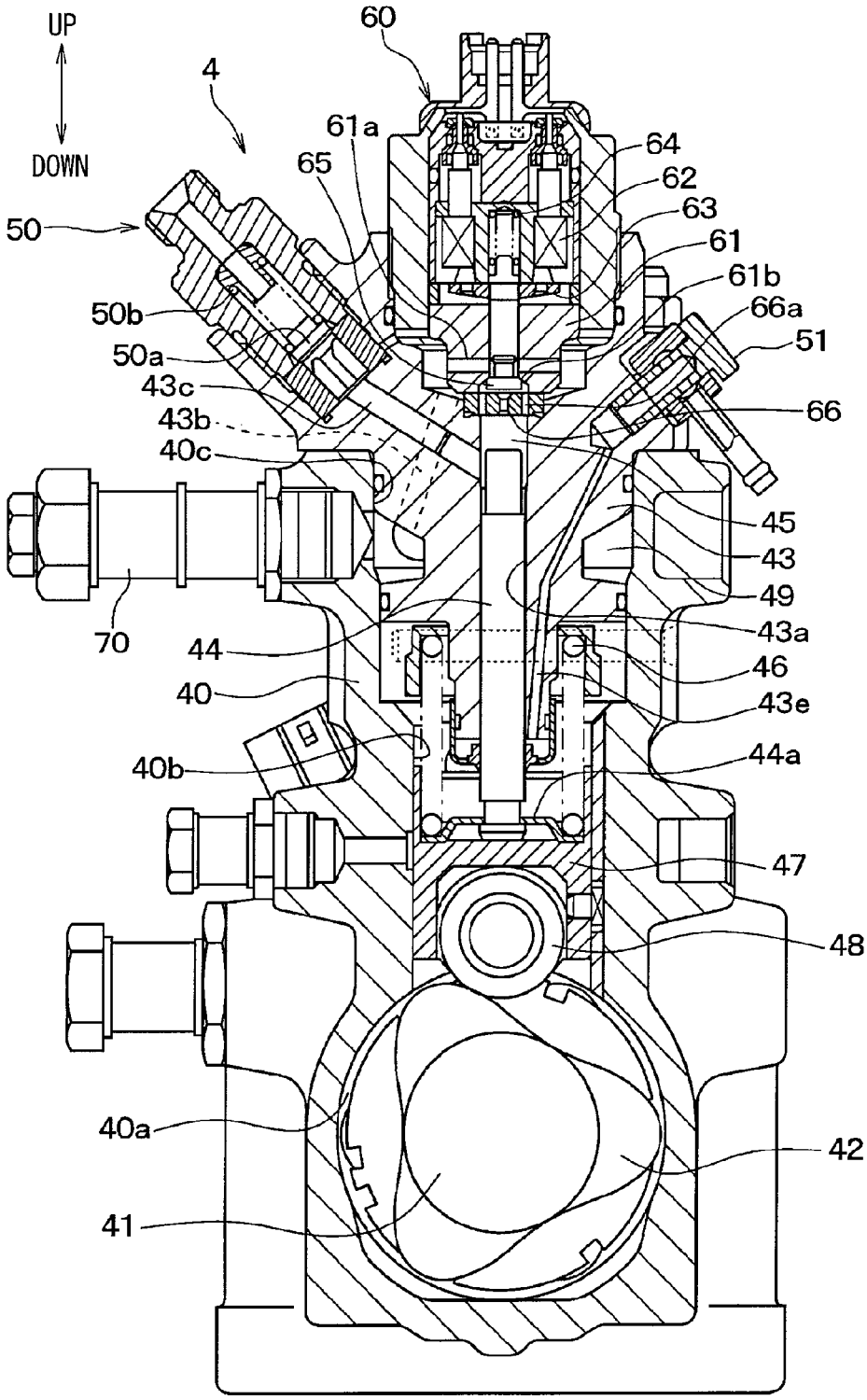
FIG. 2 is a cross sectional view of a high-pressure pump shown in FIG. 1.

Referring to FIG. 2, a specific configuration of the high-pressure pump 4 will be described hereinafter. A main housing 40 of the high-pressure pump 4 defines a cam chamber at its lower portion, a cylindrical slider-inserting portion 40*b* which extends upward from the cam chamber 40*a*, and a cylindrical cylinder-inserting portion 40*c* which extends upward from this slider-inserting portion 40*b* to the upper end of the main housing 40.

A camshaft 41 driven by the internal combustion engine is arranged in the cam chamber 40*a*. The camshaft 41 is rotatably supported by the main housing 40. The cam shaft 41 has a cam 42.

A cylinder 43 is inserted into the cylinder-inserting portion 40*c*. The cylinder 43 and the main housing 40 configure a housing of the high-pressure pump 4.

The cylinder 43 has a cylindrical plunger-inserting portion 43*a* in which a cylindrical plunger 44 is reciprocatably inserted. A plunger chamber 45 is defined by an upper end surface of the plunger 44 and an inner wall surface of the cylinder 43. A volume of the plunger chamber 45 varies along with a reciprocation of the plunger 44.

A sheet 44*a* is connected to a lower end of the plunger 44. The sheet 44*a* is forced on a slider 47 by a spring 46. The slider 47 is formed cylindrical and is reciprocatably inserted in the slider-inserting portion 40*b*.

The slider 47 has a cam roller 48 which is in contact with the cam 42. When the cam 42 is rotated, the plunger 44 is reciprocated along with the sheet 44*a*, the slider 47 and the cam roller 48.

A fuel gallery 49 is defined as a low-pressure portion between the cylinder 43 and the main housing 40. The low-pressure fuel discharged from the feed pump 3 is supplied to the fuel gallery 49 through the feed pipe 8.

The fuel gallery 49 communicates with the plunger chamber 45 through a low-pressure communication passage 43*b* formed in the cylinder 43 and a low-pressure passage 61*a* formed in a solenoid valve 60. The low-pressure communication passage 43*b* and the low-pressure passage 61*a* define a communication passage which supplies the fuel from the fuel gallery 49 to the plunger chamber 45.

The cylinder 43 has a high-pressure communication passage 43*c* which always communicate with the plunger chamber 45. The plunger chamber 45 is fluidly connected to the common-rail 5 through the high-pressure communication passage 43*c*, the discharge valve 50 and the fuel pipe 10.

The discharge valve 50 is attached to the cylinder 43 downstream of the high-pressure communication passage 43*c*. This discharge valve 50 is provided with a valve body 50*a* which opens and closes the high-pressure communication passage 43*c*, and a spring 50*b* which biases the valve body 50*a* in a valve-close direction. The fuel pressurized in the plunger chamber 45 moves the valve body 50*a* in a valve-open direction against the biasing force of the spring 50*b*, whereby the pressurized fuel is supplied to the common-rail 5.

The cylinder 43 has a purge communication passage 43*e* which always communicate with the plunger-inserting portion 43*a*. A purge valve 51 is attached to the cylinder 43 downstream of the purge communication passage 43*e*.

The fuel leaked from the plunger chamber 45 through a clearance between the plunger-inserting portion 43*a* and the plunger 44 flows out from the pump through the purge communication passage 43*e* and the purge valve 51. The flowed out fuel is returned to the fuel tank 2 through a fuel pipe (not shown).

A solenoid valve 60 is screwed in the cylinder 43 at a position confronting to an upper end surface of the plunger 44 in such a manner as to close the plunger chamber 45.

The solenoid valve 60 is provided with a body 61 which defines the low-pressure passage 61*a*. One end of the low-pressure passage 61*a* communicates with the plunger chamber 45 and the other end communicates with the low-pressure communication passage 43*b*. A sheet portion 61*b* is formed in the low-pressure passage 61*a*.

The solenoid valve 60 has a solenoid 62 which generates an electromagnetic attracting force when energized, an armature 63 which is attracted by the solenoid 62, a spring 64 which biases the armature 63 against the electromagnetic attracting force, a valve body 65 which opens and closes the low-pressure passage 61*a* in cooperation with a sheet portion 61*b*, and a stopper 66 which defines a valve-open position of the valve body 65.

That is, the spring 64 biases the valve body 65 is a valve-open direction. The solenoid 62 and the armature 63 bias the valve body 65 in the valve-close direction against the biasing force of the spring 64.

The stopper 66 is sandwiched between the solenoid valve 60 and the cylinder 43. The stopper 66 has a communication aperture 66*a* which fluidly connects the low-pressure passage 61*a* and the plunger chamber 45.

The solenoid valve 60 is controlled by the ECU. The solenoid valve 60 is a current drive valve.

Although FIG. 2 shows only one cylinder, the high-pressure pump 4 of present embodiment is a 2-cylinder pump.

Figure 3:
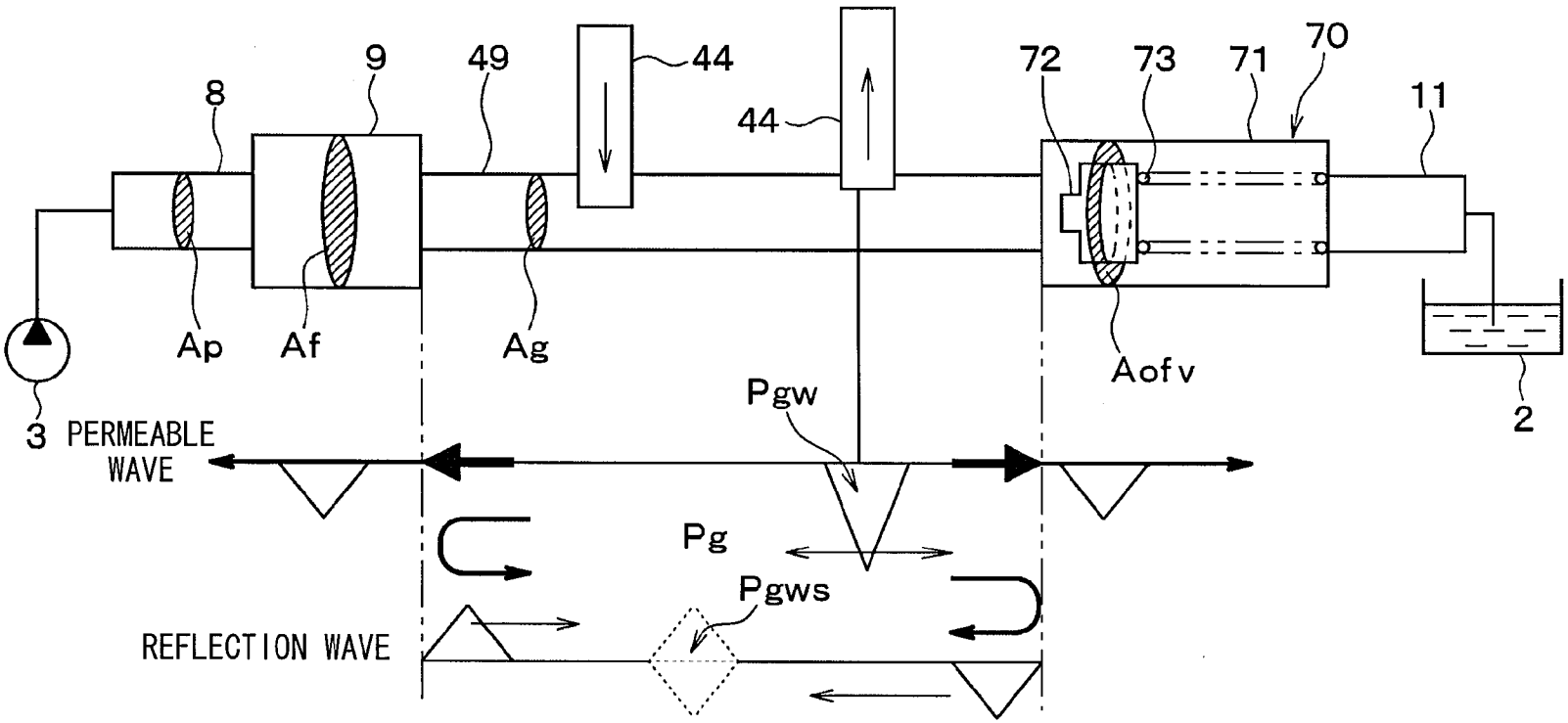
FIG. 3 is a chart showing a principal part of the fuel injection apparatus shown in FIG. 1 and showing a pressure wave propagation characteristic.

Referring to FIG. 3, the overflow valve 70, the fuel gallery 49 and the passage expansion pipe 9 will be explained in detail.

The overflow valve 70 is provided with a cylindrical housing 71. A columnar valve body 72 is slidably inserted into the housing 71 and a spring 73 biasing the valve body 72 in a valve-close direction is inserted into the housing 71. When the fuel pressure in the fuel gallery (gallery pressure)"Pg" becomes greater than or equal to a predetermined pressure, the valve body 72 moves in the valve-open direction against the biasing force of the spring 73.

A passage area "Af" of the passage expansion pipe 9 is established greater the passage area "Ag" of the fuel gallery 49. Moreover, the passage area "Af" of the passage expansion pipe 9 is established greater the passage area "Ap" of the feed pipe 8.

A passage area of the overflow valve 70 is denoted by "Aofv", a passage area of the housing 71 is denoted by "Ah", and a cross sectional area of the valve body 72 is denoted by "Av". It should be noted that the passage area of the overflow valve 70 corresponds to a clearance area between the housing 71 and the valve body 72.

$$Aofv=Ah-Av$$

According to the present embodiment, it is established as follows:

$$Aofv<Ag<Af$$

A basic operation of the above configuration will be described hereinafter. First, the fuel in the fuel tank 2 is supplied to the high-pressure pump 4 from the feed pump 3 through the feed pipe 8. The fuel supplied from the feed pump 3 is pressurized by the high-pressure pump 4 and is supplied to the common-rail 5 through the fuel pipe 10.

The fuel accumulated in the common-rail 5 is supplied to the fuel injector 6 through the fuel pipe 12, and is injected into each cylinder of the internal combustion engine.

Figure 4A:
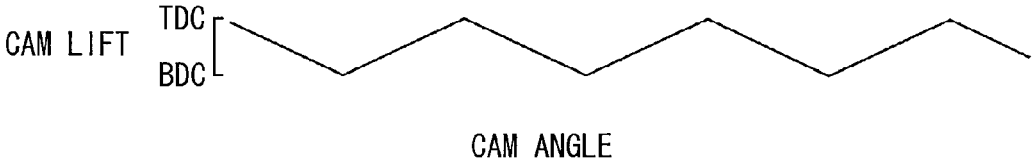
FIGS. 4A to 4C are timing charts showing an operation of the high-pressure pump.
Figure 4B:
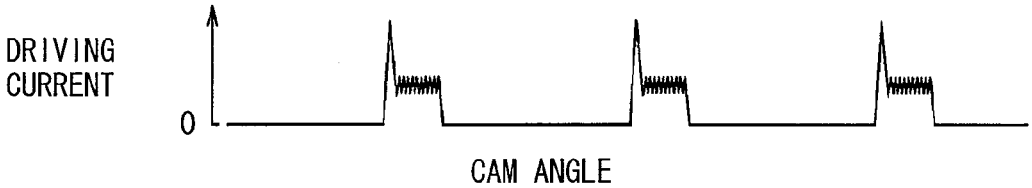

Referring to FIGS. 2 to 4, a specific operation of the high-pressure pump 4 will be described hereinafter. It should be noted that FIG. 4A shows a lift of the cam 42, and FIG. 4B shows the driving current of the solenoid valve 60 of the present embodiment. FIG. 4 C shows a driving current of a voltage-drive type solenoid valve.

In a discharge stroke of the plunger 44, the position of the cam 42 moves from a bottom dead center to a top dead center. In such a discharge stroke of the plunger 44, when the cam 42 is positioned close to a bottom dead center, the solenoid 62 of the solenoid valve 60 is not energized and the valve body 65 is positioned at the valve-open position by the biasing force of the spring 64. That is, the valve body 65 is apart from the sheet portion 61*b* of the body 61, so that the low-pressure passage 61*a* is opened.

At this moment, the plunger starts sliding up by the cam 42 and the plunger 44 starts pressurizing the fuel in the plunger chamber 45. However, since the low-pressure passage 61*a* is opened, the fuel in the plunger chamber 45 flows out toward the fuel gallery 49 through the low-pressure passage 61*a* and the low-pressure communication passage 43*b*. Thus, the fuel in the plunger chamber 45 is slightly pressurized.

Subsequently, while the fuel in the plunger chamber 45 flows out, the solenoid valve 60 is started to be energized, so that the armature 63 and the valve body 65 are attracted against the biasing force of the spring 64. The valve body 65 sits on the sheet portion 61*b* of the body 61 and the low-pressure passage 61*a* is closed.

Thereby, the flow-out of the fuel to the fuel gallery 49 is stopped, and the pressurization of the fuel in the plunger chamber 45 by the plunger 44 is substantially started. The discharge valve 50 is opened by the fuel pressure in the plunger chamber 45, and the fuel is pressure-fed to the common-rail 5.

Subsequently, before the position of the cam 42 reaches the top dead center, that is, before the plunger 44 reaches the top dead center, the solenoid valve 60 is deenergized so that the electromagnetic attracting force becomes zero. However, since the fuel pressure in the plunger chamber 45 is high at this moment, the valve body 65 is biased in the valve-close direction and the low-pressure passage 61*a* is kept closed. Thus, the fuel is continuously pressure-fed to the common-rail 5.

Subsequently, in a suction stroke of the plunger 44, the fuel pressure in the plunger chamber 45 is decreased and the valve body 65 of the solenoid valve 60 moves to the valve-open position by the biasing force of the spring 64. At this time, the electromagnetic attracting force has already become zero. Thereby, the low-pressure fuel discharged from the feed pump 3 is supplied to the plunger chamber 45 through the fuel gallery 49, the low-pressure communication passage 43*b*, and the low-pressure passage 61*a*. The high-pressure pump 4 repeats the above operation to supply the high-pressure fuel to the common-rail 5.

When the low-pressure fuel is supplied to the fuel gallery 49 in the suction stroke of the plunger 44, the passage expansion pipe 9 functions as an accumulator accumulating the fuel therein. A replenishing fuel from the passage expansion pipe 9 is added to the fuel supplied from the feed pump 3. Thus, a pressure drop in the fuel gallery 49 becomes small, so that the pressure pulsation in the fuel gallery 49 is reduced.

Figure 4C:
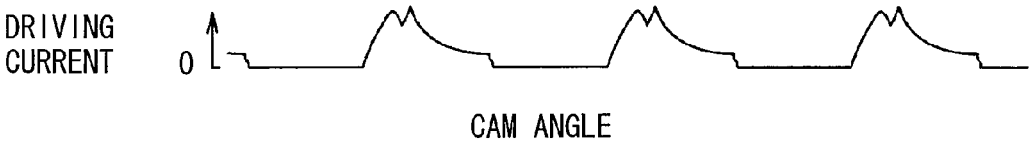

In the voltage-drive type solenoid valve, as shown in FIG. 4C, the fuel starts to be suctioned from the fuel gallery 49 to the plunger chamber 45 in the middle of the intake stroke of the plunger 44. In other words, in a condition where the pressure in the plunger chamber 45 is negative, the fuel suction to the plunger chamber 45 is started. Therefore, the fuel suction quantity per a unit time becomes larger and the pressure in the fuel gallery 49 is rapidly dropped.

Meanwhile, in the current-drive type solenoid valve 60 of the present embodiment, as shown in FIG. 4B, when the suction stroke of the plunger is started, that is, before the negative pressure is generated in the plunger chamber 45, the suction of the fuel to the plunger chamber 45 is started. Thus, it can be avoided that the pressure in the fuel gallery 49 is rapidly dropped.

Furthermore, when the solenoid valve 60 is closed and the pressure in the fuel gallery 49 becomes greater than or equal to a predetermined pressure, the valve body 72 of the overflow valve 70 moves in the valve-open direction against the biasing force of the spring 73. The fuel in the fuel gallery 49 is returned to the fuel tank 2 through the fuel pipe 11.

At this time, the volume of the fuel gallery 49 is varied by a volume which is obtained by multiplying a moving distance of the valve body 72 and the cross sectional area "Av" of the valve body 72. Since the pressure variation in the fuel gallery 49 is absorbed by the volumetric variation of the fuel gallery 49, the pressure pulsation in the fuel gallery 49 can be reduced.

As shown in FIG. 3, when the solenoid valve 60 is opened or closed, a pressure wave "Pgw" due to a water hammer easily occurs in the fuel gallery 49.

The pressure wave "Pgw" in the fuel gallery 49 is reflected at a boundary portion of the fuel gallery 49 and the passage expansion pipe 9. Since the passage area expands at the boundary portion, that is, since the area "Ag" is less than the area "Af", the reflected wave becomes a phase inversion reflected wave. Also, the pressure wave "Pgw" in the fuel gallery 49 is reflected at a boundary portion of the fuel gallery 49 and the overflow valve 70. Since the passage area is decreased at the boundary portion, that is, since the area "Aofv" is less than the area "Ag", the reflected wave becomes a normal reflected wave. The phase inversion reflected wave and the normal reflected wave are composed, whereby its pressure amplitude becomes smaller and the pressure pulsation in the fuel gallery 49 is reduced.

When the pressure wave "Pgw" is reflected at the boundary portion of the fuel gallery 49 and the passage expansion pipe 9, its reflection coefficient is denoted by "Z1". When the pressure wave "Pgw" is reflected at the boundary portion of the fuel gallery 49 and the overflow valve 70, its reflection coefficient is denoted by "Z2". The pressure pulsation reduction effect by composing the phase inversion reflected wave and the normal reflected wave can be certainly acquired by establishing the reflection coefficients as follows:

$$Z1=-0.5\pm0.1;\ Z2=0.5\pm0.1$$

The pressure pulsation reduction effect will be described in detail, hereinafter. First, it is supposed that the pressure wave "Pgw" becomes the composed reflected wave "Pgws" after composed.

At the boundary portion of the fuel gallery 49 and the passage expansion pipe 9, a passage area ratio "x" therebetween is expressed by follows:

$$x=Af/Ag$$

At the boundary portion of the fuel gallery 49 and the overflow valve 70, a passage area ratio "y" therebetween is expressed by follows:

$$y=Aofv/Ag$$

$$Z1=(Ag-Af)/(Ag+Af)=(1-x)/(1+x).$$

$$Z2=(Ag-Aofv)/(Ag+Aofv)=(1-y)/(1+y).$$

$$1<x,\ y<1,\ Z1<0,\ 0<Z2$$

Figure 5:
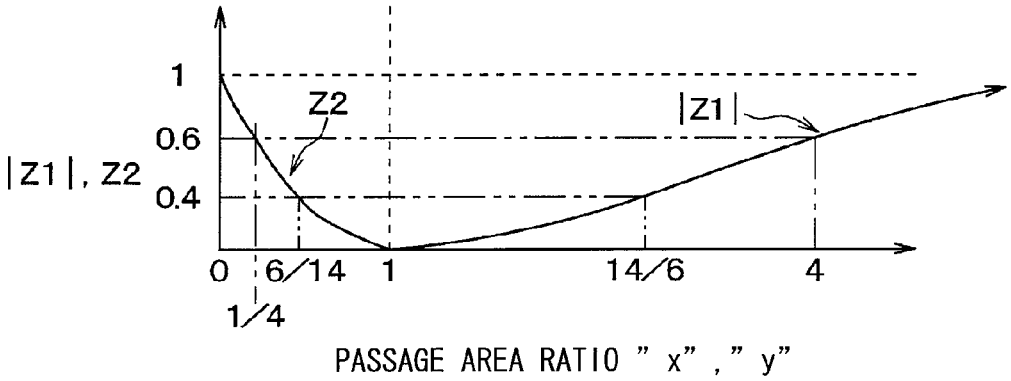
FIG. 5 is a graph showing a relationship between a reflection coefficient and passage area ratio in the fuel injection apparatus shown in FIG. 1.

FIG. 5 is a graph showing a relationship between the reflection coefficients and the passage area ratios. A vertical axis represents an absolute value of the coefficient |Z1| and the reflection coefficient "Z2". A horizontal axis represents the passage area ratios "x" and "y".

In order to protect the feed pump 3, a propagation of the pressure wave "Pgw" to the feed pump 3 should be limited as much as possible. Therefore, the passage area ratio "x" should be established larger as much as possible ($x\rightarrow\infty$). Meanwhile, in order to avoid the water hammer on the overflow valve 70, the passage area ratio "y" should be established larger as much as possible ($y\rightarrow1$).

In view of an implementability of the passage areas, the reflection coefficient and the permeability coefficient (=1−reflection coefficient) should be made as values around an equal value.

In a rage where Z1=−0.5±0.1 and Z2=0.5±0.1, it is established as follows:

$$Z1+Z2=Pgws/Pgw=-0.2 \text{ to } +0.2.$$

That is, a water hammer absolute value is attenuated to ⅕ or less.

$$|Z1|=Z2=0.5\pm0.1\ x=14/6 \text{ to } 4,\ y=1/4 \text{ to } 6/14$$

According to present embodiment as stated above, the passage expansion pipe 9 functions as an accumulator accumulating the fuel therein. The replenishing fuel from the passage expansion pipe 9 is added to the fuel supplied from the feed pump 3. Thus, a pressure drop in the fuel gallery 49 becomes small, so that the pressure pulsation in the fuel gallery 49 is reduced.

Further, when the suction stroke of the plunger is started, that is, before the negative pressure is generated in the plunger chamber 45, the suction of the fuel to the plunger chamber 45 is started. Thus, it can be avoided that the pressure in the fuel gallery 49 is rapidly dropped.

Moreover, since the pressure variation in the fuel gallery 49 is absorbed by the volumetric variation of the fuel gallery 49, the pressure pulsation in the fuel gallery 49 can be reduced.

When the pressure wave "Pgw" due to a water hammer occurs in the fuel gallery 49, the phase inversion reflected wave and the normal reflected wave are composed, whereby the pressure wave "Pgw" is attenuated and the pressure pulsation in the fuel gallery 49 is reduced.

As described above, the pressure pulsation in the fuel gallery 49 is reduced and a vaporization of the liquefied gas fuel in the fuel gallery 49 is restricted, whereby the fuel can be certainly pressure-fed. Moreover, a seal member for maintaining an oil-tight of the fuel gallery 49 can be protected, and a fuel leak can be avoided.

Second Embodiment

Hereafter, a second embodiment will be described. Configurations different from the first embodiment will be described below.

Figure 6:
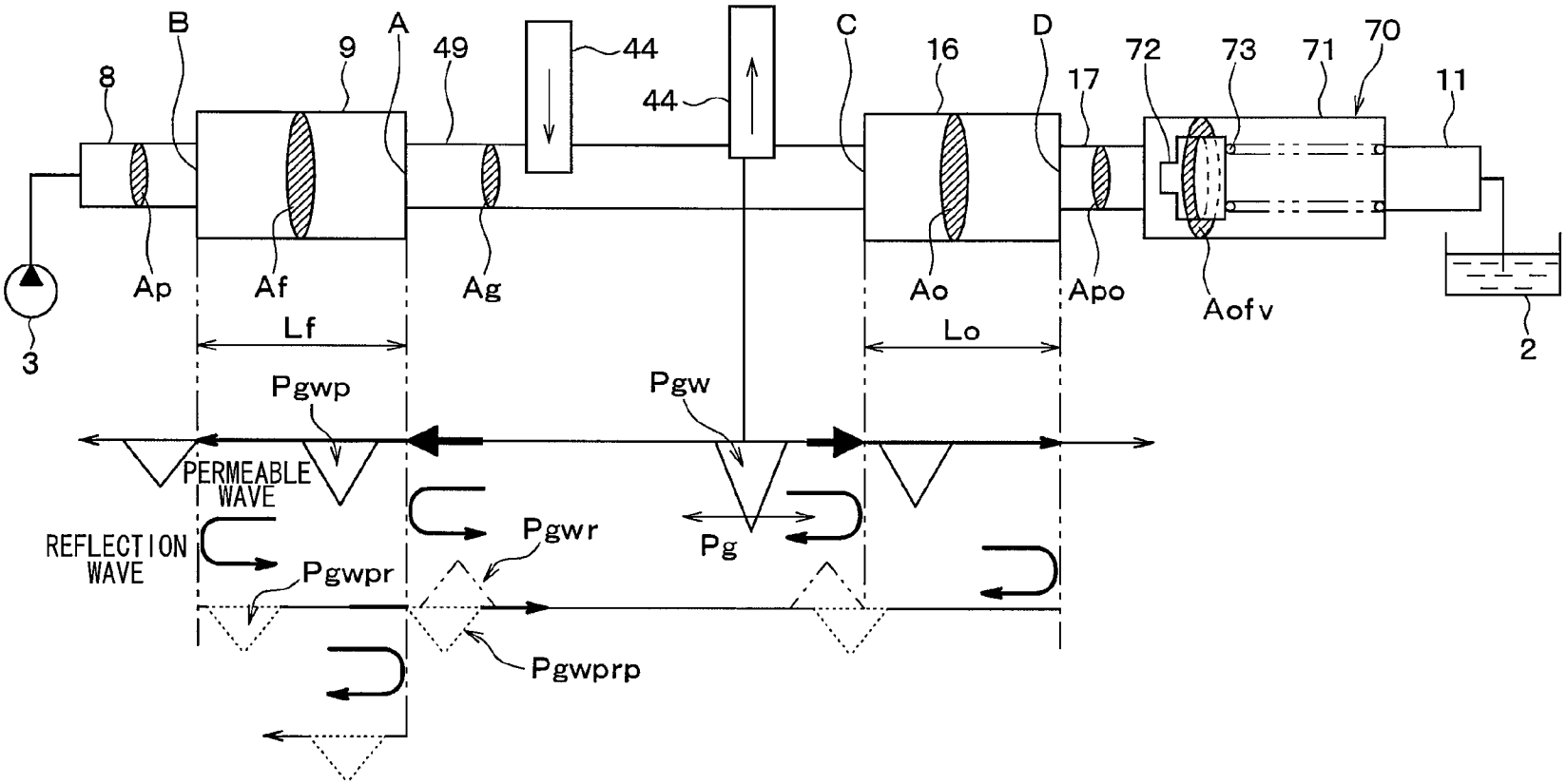
FIG. 6 is a chart showing a principal part of a fuel injection apparatus and a pressure wave propagation characteristic according to a second embodiment.

As shown in FIG. 6, the high-pressure pump is provided with a passage expansion pipe 16 and a fuel pipe 17 between the fuel gallery 49 and the overflow valve 70.

A passage area "Ao" of the passage expansion pipe 16 is established greater the passage area "Ag" of the fuel gallery 49. Moreover, the passage area "Ao" of the passage expansion pipe 16 is established greater the passage area "Apo" of the fuel pipe 17.

An operation of a pressure pulsation reduction will be described.

First, a part of the pressure wave "Pgw" generated in the fuel gallery 49 is reflected at a boundary portion "A" and its phase inverts. The boundary portion "A" is formed between the fuel gallery 49 and the passage expansion pipe 9. This phase inversion reflection wave is referred to as A-reflection wave "Pgwr". The other of the pressure wave "Pgw" passes through the boundary portion "A" and flows into the feed pipe 8. This passed wave is referred to as A-permeable wave "Pgwp".

Moreover, a part of the A-permeable wave "Pgwp" is normally reflected at a boundary portion "B". The boundary portion "B" is formed between the feed pipe 8 and the passage expansion pipe 9. This normally reflected wave is referred to as B-reflection wave "Pgwpr". A part of the B-reflection wave "Pgwpr" passes through the boundary portion "A" and flows into the fuel gallery 49. This wave is referred to as A-re-permeable wave "Pgwprp".

The A-reflection wave "Pgwr" and the A-re-permeable wave "Pgwprp" are composed, whereby its pressure amplitude becomes smaller and the pressure pulsation in the fuel gallery 49 is reduced.

Similarly, a part of the pressure wave "Pgw" generated in the fuel gallery 49 is reflected at a boundary portion "C" and its phase inverts. The boundary portion "C" is formed between the fuel gallery 49 and the passage expansion pipe 16. This phase inversion reflection wave is referred to as C-reflection wave. The other of the pressure wave "Pgw" passes through the boundary portion "C" and flows into the fuel pipe 17. This passed wave is referred to as C-permeable wave.

Moreover, a part of the C-permeable wave is normally reflected at a boundary portion "D". The boundary portion "D" is formed between the fuel pipe 17 and the passage expansion pipe 16. This normally reflected wave is referred to as D-reflection wave. A part of the D-reflection wave passes through the boundary portion "C" and flows into the fuel gallery 49. This wave is referred to as C-re-permeable wave.

The C-reflection wave and the C-re-permeable wave are composed, whereby its pressure amplitude becomes smaller and the pressure pulsation in the fuel gallery 49 is reduced.

When the A-reflection wave "Pgwr" and an absolute value of the A-re-permeable wave "Pgwprp" are made equal to each other and their positive/negative is reversed, the pressure wave "Pgw" can be attenuated. When the specifications of the above waves are defined as follows, a pressure wave attenuation effect can be obtained practically enough.

The reflection coefficient of the pressure wave "Pgw" reflecting at the boundary portion "A" is (Ag−Af)/(Ag+Af). The permeability coefficient of the pressure wave "Pgw" passing through the boundary portion "A" is 2Ag/(Ag+Af). The reflection coefficient of the A-permeable wave "Pgwp" reflecting at the boundary portion "B" is (Af−Ap)/(Af+Ap). The permeability coefficient of the B-reflection wave "Pgwpr" passing through the boundary portion "A" is 2Af/(Af+Ag).

It is assumed that |(Ag−Af)/(Ag+Af)|=|[2Ag/(Ag+Af)][(Af−Ap)/(Af+Ap)][2Af/(Af+Ag)]|

For example, when it is assumed that the A-reflection wave "Pgwr" is reflected by (Ag−Af)/(Ag+Af)=−1/4, the ratio (Af/Ag) is 5/3 and the ratio (Ap/Ag) is 55/57.

Practically, when the ratio (Af/Ag) is 4/3 to 2 and Ag=Ap=Apo, the pressure wave attenuation effect can be obtained enough by composing the A-reflection wave "Pgwr" and the A-re-permeable wave "Pgwprp".

Similarly, when the ratio (Ao/Ag) is 4/3 to 2 and Ag=Ap=Apo, the pressure wave attenuation effect can be obtained enough by composing the C-reflection wave and the C-re-permeable wave.

In view of a time period in which the pressure wave reciprocates in the passage expansion pipe 9 at the acoustic velocity "a", it is necessary that a length "Lf" of the passage expansion pipe 9 should be close to zero as much as possible in order to cancel the A-reflection wave "Pgwr" by the A-re-permeable wave "Pgwprp".

The acoustic velocity in liquid is not less than 1000 m/sec. In a case that the length "Lf" is 100 mm, the time period in which the pressure wave reciprocates in the passage expansion pipe 9 at the acoustic velocity "a" is as follows:

$$2Lf/a=2\times100(\text{mm})/1000(\text{m/s})=0.2\ \text{msec.}$$

When a periodic time of the pressure pulsation in the fuel gallery 49 is 5 msec or more and the phase shift of a wave is 0.1 to 1 msec, it is practically satisfactory. Therefore, the length "Lf" is established to 500 mm or less. Similarly, the length "Lo" of the passage expansion pipe 16 is established to 500 mm or less.

According to the present embodiment, two passage expansion pipes 9 and 16 function as the accumulators accumulating the fuel therein. The replenishing fuel from the passage expansion pipes 9 and 16 is added to the fuel supplied from the feed pump 3. Thus, a pressure drop in the fuel gallery 49 becomes small, so that the pressure pulsation in the fuel gallery 49 is reduced significantly.

Therefore, the pressure pulsation in the fuel gallery 49 is reduced and a vaporization of the liquefied gas fuel in the fuel gallery 49 is restricted, whereby the fuel can be certainly pressure-fed. Moreover, a seal member for maintaining an oil-tight of the fuel gallery 49 can be protected, and a fuel leak can be avoided.

Moreover, since each pressure pulsation is attenuated at end portions of the passage expansion pipes 9, 16, the attenuation of the pressure pulsation receives no influence from complicated pressure waveforms in the fuel gallery 49 which are generated when two plungers 44 slide.

Furthermore, in the present embodiment, since it is unnecessary that the pressure wave "Pgw" in the fuel gallery 49 is reflected at the overflow valve 70, the passage area "Aofv" and the pressure characteristics of the overflow valve 70 can be established arbitrarily.

In the first embodiment, the phase inversion reflected wave and the normal reflected wave are composed, whereby the pressure wave "Pgw" is attenuated and the pressure pulsation in the fuel gallery 49 is reduced. Meanwhile, according to the present embodiment, the A-reflection wave "Pgwr" and the A-re-permeable wave "Pgwprp" are composed at the boundary portion "A", and the C-reflection wave and the C-re-permeable wave are composed at the boundary portion "C".

Thus, the attenuation effect can be achieved with respect to any complicated water hammer waves in a fuel gallery even if the configurations of the pump and fuel galley are complicated.

Other Embodiment

In each of the above-mentioned embodiments, a pulsation damper may be connected to the fuel gallery 49 or a cross section area "Av" of the valve body 72 of the overflow valve 70 may be enlarged, whereby the pressure in the fuel gallery 49 is further stabilized. Moreover, the valve body 72 of the overflow valve 70 is not limited to a columnar valve. The valve body 72 may be a sphere valve.

The present disclosure is not limited to the embodiment mentioned above, and can be applied to various embodiments.

Moreover, each embodiment can be suitably combined.

Moreover, in each above-mentioned embodiment, all elements are not always necessary.

In each above-mentioned embodiment, the number of the component, the numerical value, the quantity and the value range are not limited to those in each embodiment.

Moreover, in each above-mentioned embodiment, the shapes of the components, and the position of the components are not limited to those in each embodiment.

What is claimed is:

1. A fuel injection apparatus comprising:

a fuel tank containing a liquefied gas fuel;

a feed pump feeding the liquefied gas fuel from the fuel tank;

a high-pressure pump pressurizing and discharging the liquefied gas fuel supplied from the feed pump; and a feed pipe introducing the liquefied gas fuel to the high-pressure pump from the feed pump, wherein:

the high-pressure pump is provided with:

a plunger reciprocating to pressurize the liquefied gas fuel;

a housing defining a plunger chamber of which volume is varied according to a reciprocating movement of the plunger, the housing defining a fuel gallery into which the liquefied gas fuel is introduced through the feed pipe and from which the liquefied gas fuel is supplied to the plunger chamber; and a solenoid valve opening and closing a communication passage fluidly connecting the fuel gallery and the plunger chamber, the fuel injection apparatus further comprises a passage expansion pipe of which passage area is greater than that of the fuel gallery, the passage expansion pipe being arranged between the feed pipe and the passage expansion pipe, the high-pressure pump is provided with an overflow valve having a valve body which moves in a valve-open direction so as to return the liquefied gas fuel in the fuel gallery to the fuel tank when a pressure in the fuel gallery becomes greater than a predetermined pressure; and a passage area "Ag" of the fuel gallery, a passage area "Af" of the passage expansion pipe and a passage area "Aofv" of the overflow valve has a following relationship:

$$Aofv<Ag<Af.$$

2. A fuel injection apparatus according to claim 1, wherein:

when the pressure wave in the fuel gallery is reflected at a boundary portion of the fuel gallery and the passage expansion pipe, its reflection coefficient is denoted by "Z1", when the pressure wave in the fuel gallery is reflected at the boundary portion of the fuel gallery and the overflow valve, its reflection coefficient is denoted by "Z2", and the value of the reflection coefficients "Z1" and "Z2" are defined as follows:

$$Z1=-0.5\pm0.1, \text{ and } Z2=0.5\pm0.1.$$

3. A fuel injection apparatus according to claim 1, wherein:

the overflow valve is configured in such a manner as to vary a volume of the fuel gallery by a specified volume which is obtained by multiplying a moving distance of the valve body and the cross sectional area of the valve body.

4. A fuel injection apparatus according to claim 1, wherein:

the solenoid valve has a valve body which closes the communication passage by an electromagnetic attracting force; and the electromagnetic attracting force is controlled to become zero before the plunger reaches its top dead center.

5. A fuel injection apparatus according to claim 1, further comprising: a passage expansion pipe of which passage area is greater than that of the fuel gallery, the passage expansion pipe being arranged between the fuel gallery and the overflow valve.

* * * * *